US006283476B1

(12) United States Patent
Henry et al.

(10) Patent No.: US 6,283,476 B1
(45) Date of Patent: Sep. 4, 2001

(54) WORD-FORMING GAME AND METHOD OF PLAYING THE SAME

(76) Inventors: Anthony G. Henry; Beverly Henry, both of 10920 Water Port Ct., Mitchellville, MD (US) 20721-2926

( * ) Notice: Subject to any disclaimer, the term of this patent is extended or adjusted under 35 U.S.C. 154(b) by 0 days.

(21) Appl. No.: 09/586,361

(22) Filed: Jun. 2, 2000

(51) Int. Cl.[7] ..... A63F 9/00
(52) U.S. Cl. ..... 273/459; 434/159
(58) Field of Search ..... 273/430, 459; 434/156, 159, 167

(56) References Cited

U.S. PATENT DOCUMENTS 4,884,815 * 12/1989 Glenn ..... 273/430
5,056,798 * 10/1991 Wehrley ..... 273/459
5,984,311 * 11/1999 Stefanik et al. ..... 273/459

* cited by examiner

*Primary Examiner*—Sam Rimell

(57) ABSTRACT

A word-forming game and the method of playing the same for entertaining persons riding within a vehicle. The word-forming game and the method of playing the same includes a scorecard. The scorecard has a plurality of rows and columns thereon. Each of the rows has number indicia thereby, and each of the columns has a heading indicia thereon. Players select letters from license plates of vehicles. A combination of the selected letters is identified. Up to two letters may be added between the selected letters of the combination to form word combinations. The word combinations are placed in the columns. The player receives a plurality of points equal to the number of letters in each of the word combinations. The points are summed and the player having the greatest amount of points wins the game.

14 Claims, 2 Drawing Sheets

WORD-FORMING GAME AND METHOD OF PLAYING THE SAME

BACKGROUND OF THE INVENTION

1. Field of the Invention

The present invention relates to word games and more particularly pertains to a new word-forming game and the method of playing the same for entertaining persons riding within a vehicle.

2. Description of the Prior Art

The use of word games is known in the prior art. More specifically, word games heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,884,815; 4,201,389; U.S. Des. Pat. No. 321,400; U.S. Pat. Nos. 3,746,342; 5,269,530; and 5,055,049.

While these devices fulfill their respective, particular objectives and requirements, the aforementioned patents do not disclose a new word-forming game and the method of playing the same. The inventive device includes a scorecard. The scorecard has a plurality of rows and columns thereon. Each of the rows has number indicia thereby, and each of the columns has a heading indicia thereon. Players select letters from license plates of vehicles. A combination of the selected letters is identified. Up to two letters may be added between the selected letters of the combination to form word combinations. The word combinations are placed in the columns. The player receives a plurality of points equal to the number of letters in each of the word combinations. The points are summed and the player having the greatest amount of points wins the game.

In these respects, the word-forming game and the method of playing the same according to the present invention substantially departs from the conventional concepts and designs of the prior art, and in so doing provides an apparatus primarily developed for the purpose of entertaining persons riding within a vehicle.

SUMMARY OF THE INVENTION

In view of the foregoing disadvantages inherent in the known types of word games now present in the prior art, the present invention provides a new word-forming game and the method of playing the same construction wherein the same can be utilized for entertaining persons riding within a vehicle.

The general purpose of the present invention, which will be described subsequently in greater detail, is to provide a new word-forming game and the method of playing the same apparatus and method which has many of the advantages of the word games mentioned heretofore and many novel features that result in a new word-forming game and the method of playing the same which is not anticipated, rendered obvious, suggested, or even implied by any of the prior art word games, either alone or in any combination thereof.

To attain this, the present invention generally comprises a scorecard. The scorecard has a plurality of rows and columns thereon. Each of the rows has number indicia thereby, and each of the columns has a heading indicia thereon. Players select letters from license plates of vehicles. A combination of the selected letters is identified. Up to two letters may be added between the selected letters of the combination to form word combinations. The word combinations are placed in the columns. The player receives a plurality of points equal to the number of letters in each of the word combinations. The points are summed and the player having the greatest amount of points wins the game.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new word-forming game and the method of playing the same apparatus and method which has many of the advantages of the word games mentioned heretofore and many novel features that result in a new word-forming game and the method of playing the same which is not anticipated, rendered obvious, suggested, or even implied by any of the prior art word games, either alone or in any combination thereof.

It is another object of the present invention to provide a new word-forming game and the method of playing the same which may be easily and efficiently manufactured and marketed.

It is a further object of the present invention to provide a new word-forming game and the method of playing the same which is of a durable and reliable construction.

An even further object of the present invention is to provide a new word-forming game and the method of playing the same which is susceptible of a low cost of manufacture with regard to both materials and labor, and which accordingly is then susceptible of low prices of sale to the consuming public, thereby making such word-forming game and the method of playing the same economically available to the buying public.

Still yet another object of the present invention is to provide a new word-forming game and the method of playing the same which provides in the apparatuses and methods of the prior art some of the advantages thereof, while simultaneously overcoming some of the disadvantages normally associated therewith.

Still another object of the present invention is to provide a new word-forming game and the method of playing the same for entertaining persons riding within a vehicle.

Yet another object of the present invention is to provide a new word-forming game and the method of playing the same which includes a scorecard. The scorecard has a plurality of rows and columns thereon. Each of the rows has number indicia thereby, and each of the columns has a heading indicia thereon. Players select letters from license plates of vehicles. A combination of the selected letters is identified. Up to two letters may be added between the selected letters of the combination to form word combinations. The word combinations are placed in the columns. The player receives a plurality of points equal to the number of letters in each of the word combinations. The points are summed and the player having the greatest amount of points wins the game.

Still yet another object of the present invention is to provide a new word-forming game and the method of playing the same that enhances the vocabulary of the participants of the game.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
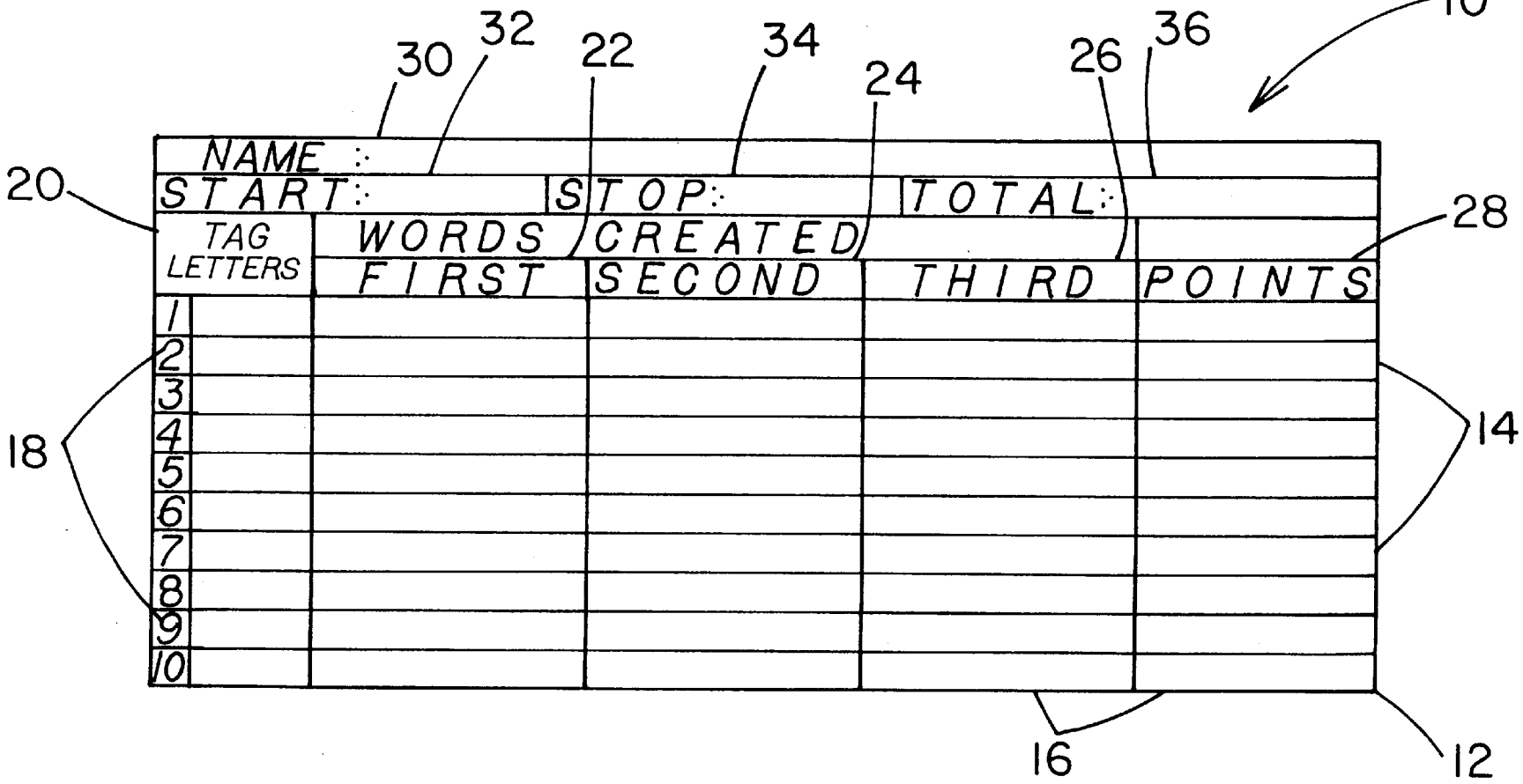
FIG. 1 is a schematic plan view of the scorecard of a new word-forming game and the method of playing the same according to the present invention.
Figure 2:
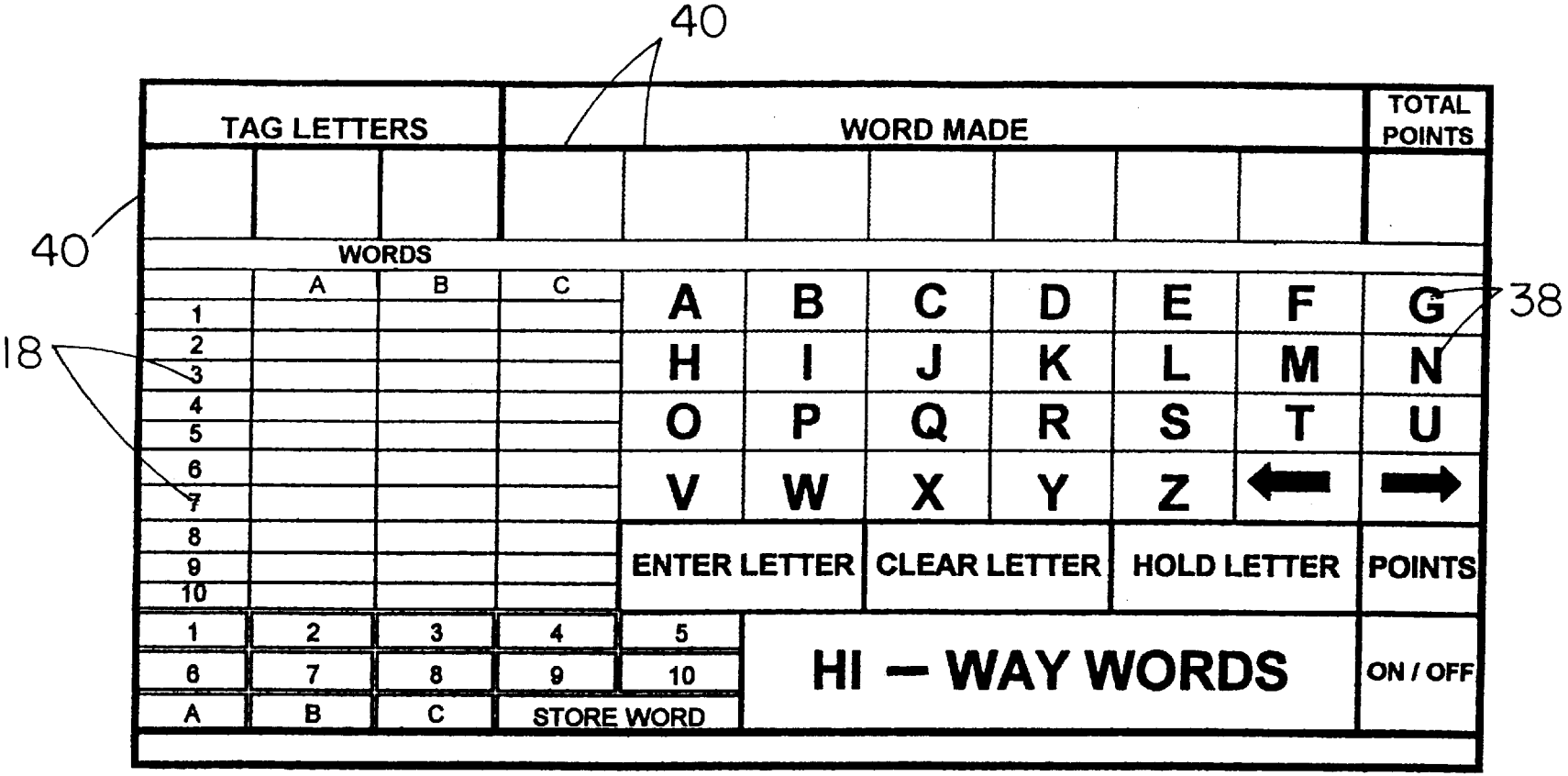
FIG. 2 is a schematic plan view of the electronic scorecard of the present invention.

With reference now to the drawings, and in particular to FIGS. 1 through 2 thereof, a new word-forming game and the method of playing the same embodying the principles and concepts of the present invention and generally designated by the reference numeral 10 will be described.

As best illustrated in FIGS. 1 through 2, the word-forming game and the method of playing the same 10 generally comprises a scorecard 12. The scorecard has a plurality of rows 14 and columns 16 thereon. Each of the rows 14 has number indicia 18 positioned adjacently thereby. Each of the columns 16 has heading indicia thereon. The plurality of columns 16 is preferably five columns. The heading indicia is selected from the group consisting of letter, first, second, third, and points such that a letter column 20, a first column 22, a second column 24, a third column 26 and a points column 28 are defined. The scorecard 12 has indicia thereon and an adjacent space thereby for indicating a name 30, a start time 32, an ending time 34 and a total number of points 36. There are ten rows 14 each having an adjacent one of the number indicia 18. The scorecard 12 is ideally a plurality of scorecards, each of which comprises a sheet of paper. A writing means, not shown, is used for writing on the scorecards 12 and may comprise a pencil or other conventional writing means.

A second version of the scorecard is shown in FIG. 2. The second version is an electronic version having a keypad having letter indicia 38 for entering letters and word combinations. The letters are stored in the scorecard by control circuitry, which is powered by a battery. The second version has a plurality of display windows 40 for viewing entered information.

Game Rules

The game may be played by a plurality of players.

Letters are selected from license plates of vehicles.

The selected letters are listed in the letter column 20 such that each row contains 14 the letters from a license plate.

The selecting and listing of letters is repeated until all of the rows in the letters column have license plate letters therein.

A combination of the selected letters in each of the rows is identified.

Up to two letters may be added between the selected letters of the combination to form word combinations. For example, if the letters chosen are NGT, the letter "I" may be placed between the N and the G and the letter "H" may be placed between the G and T to form the word NIGHT. Letters may not be added before the N or after the T.

A first word combination is written in the first column 22, a second word combination is written in the second column 24, and a third word combination is written in the third column 26 for each of the rows of selected letters. The players have a limited time to write the word combinations. Preferably, the limited time is substantially equal to fifteen minutes. When forming word combinations, the players may not form proper names.

A plurality of points is received which is equal to the number of letters in each of the word combinations. Thus, the word NIGHT is worth 5 points as there are 5 letters in that word. The points for each row are placed in the point column 28, which is added up to place a total point count in the total number of points position 36.

The points are added the player having the most amount of points wins the game.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A method of playing a word-forming game using letters obtained from vehicle license plates comprising the steps of:

providing a scorecard, said scorecard having a plurality of rows and columns thereon, each of said rows having a number indicia thereby, each of said columns having a heading indicia thereon;

providing a plurality of players;

selecting letters from license plates of vehicles;

identifying a combination of said selected letters;

adding up to two letters between said selected letters of said combination to form word combinations;

placing said word combinations in said columns;

receiving a plurality of points equal to the number of letters in each of said word combinations;

summing said points; and winning the game by having the greatest number of points.

2. The method of playing a word-forming game as in claim 1, wherein the step of providing a scorecard further comprises:

said plurality of columns being five columns, said heading indicia being selected from the group consisting of letter, first, second, third, and points such that a letter column, first column, second column, third column and points column are defined.

3. The method of playing a word-forming game as in claim 2, wherein the step of providing a scorecard further comprises:

said scorecard having indicia thereon and an adjacent space thereby for indicating a name, a start time, an ending time and a total number of points, wherein there are ten rows each having an adjacent one of said number indicia, said scorecard being a plurality of scorecards, each of said scorecards comprising a sheet of paper.

4. The method of playing a word-forming game as in claim 2, further comprising the steps of:

listing said selected letters in said letter column such that each row contains the letters from a license plate;

repeatedly selecting and listing said letters until all of said rows in said letters column have license plate letters therein;

identifying a combination of said selected letters in each of said rows; and writing a first word combination in said first column, a second word combination in said second column, and a third word combination in said third column for each of said rows of selected letters.

5. The method of playing a word-forming game as in claim 4, wherein said players having a limited time to write said word combinations, said limited time being substantially equal to fifteen minutes.

6. The method of playing a word-forming game as in claim 1, wherein the step of providing a scorecard further comprises:

said scorecard being an electronic scorecard, said scorecard having a front panel, said front panel having a plurality of letter indicia thereon, each of said letter indicia being adapted for entering selected letters into said scorecard, wherein said players enter said selected letters and word combinations into said scorecard.

7. A method of playing a word-forming game using letters obtained from vehicle license plates comprising the steps of:

providing a scorecard, said scorecard having a plurality of rows and columns thereon, each of said rows having a number indicia thereby, each of said columns having a heading indicia thereon, said plurality of columns being five columns, said heading indicia being selected from the group consisting of letter, first, second, third, and points such that a letter column, first column, second column, third column and points column are defined, said scorecard having indicia thereon and an adjacent space thereby for indicating a name, a start time, an ending time and a total number of points, wherein there are ten rows each having an adjacent one of said number indicia, said scorecard being a plurality of scorecards, each of said scorecards comprising a sheet of paper;

providing a writing means for writing on said scorecards, said writing means being a pencil;

providing a plurality of players;

selecting letters from license plates of vehicles;

listing said selected letters in said letter column such that each row contains the letters from a license plate;

repeatedly selecting and listing said letters until all of said rows in said letters column have license plate letters therein;

identifying a combination of said selected letters in each of said rows;

adding up to two letters between said selected letters of said combination to form word combinations;

writing a first word combination in said first column, a second word combination in said second column, and a third word combination in said third column for each of said rows of selected letters, said players having a limited time to write said word combinations, said limited time being substantially equal to fifteen minutes;

receiving a plurality of points equal to the number of letters in each of said word combinations;

summing said points; and winning the game by having the greatest number of points.

8. A method of playing a word-forming game using letters obtained from vehicle license plates comprising the steps of:

providing a scorecard having a plurality of rows and columns thereon, each of said rows having a number indicia associated therewith, each of said columns having a heading indicia associated therewith;

selecting letters from license plates of vehicles;

identifying a combination of said selected letters;

adding up to two letters between said selected letters of said combination to form word combinations;

placing said word combinations in said columns;

receiving a plurality of points equal to the number of letters in each of said word combinations;

summing said points; and winning the game by having the greatest number of points.

9. The method of playing a word-forming game as in claim 1, wherein the step of providing a scorecard further comprises:

said plurality of columns being five columns, said heading indicia being selected from the group consisting of letter, first, second, third, and points such that a letter column, first column, second column, third column and points column are defined.

10. The method of playing a word-forming game as in claim 9, wherein the step of providing a scorecard further comprises:

said scorecard having indicia thereon and an adjacent space thereby for indicating a name, a start time, an ending time and a total number of points, wherein there are ten rows each having an adjacent one of said number indicia, said scorecard being a plurality of scorecards, each of said scorecards comprising a sheet of paper.

11. The method of playing a word-forming game as in claim 9, further comprising the steps of:

listing said selected letters in said letter column such that each row contains the letters from a license plate;

repeatedly selecting and listing said letters until all of said rows in said letters column have license plate letters therein;

identifying a combination of said selected letters in each of said rows; and writing a first word combination in said first column, a second word combination in said second column, and a third word combination in said third column for each of said rows of selected letters.

12. The method of playing a word-forming game as in claim 11, wherein said players having a limited time to write said word combinations.

13. The method of playing a word-forming game as in claim 12, wherein said limited time is substantially equal to fifteen minutes.

14. The method of playing a word-forming game as in claim 8, wherein the step of providing a scorecard further comprises:

said scorecard being an electronic scorecard, said scorecard having a front panel, said front panel having a plurality of letter indicia thereon, each of said letter indicia being adapted for entering selected letters into said scorecard, wherein said players enter said selected letters and word combinations into said scorecard.

* * * * *